United States Patent [19]

Ackeret

[11] Patent Number: 4,774,779

[45] Date of Patent: Oct. 4, 1988

[54] HOLDER FOR A STACK OF PICTURES

[75] Inventor: Peter Ackeret, Küsnacht, Switzerland

[73] Assignee: Licinvest AG, Chur, Switzerland

[21] Appl. No.: 929,835

[22] Filed: Nov. 13, 1986

Related U.S. Application Data

[62] Division of Ser. No. 537,521, Sep. 30, 1983, abandoned.

[30] Foreign Application Priority Data

Oct. 4, 1982 [DE] Fed. Rep. of Germany ..... 3236641

[51] Int. Cl.[4] ..... G09F 3/18

[52] U.S. Cl. ..... 40/642; 40/511; 40/513

[58] Field of Search ..... 40/513, 511, 10 R, 156, 40/10 D, 10

[56] References Cited

U.S. PATENT DOCUMENTS

| | | | |
|---|---|---|---|
| 2,367,071 | 1/1945 | Tarlitz | 40/152.1 |
| 2,434,860 | 1/1948 | Oxley | 248/34 |
| 2,747,311 | 5/1956 | Fulmer | 40/156 |
| 2,806,309 | 9/1957 | Goldberg | 40/152 |
| 2,919,509 | 1/1960 | Strandberg | 40/63 |
| 3,377,727 | 4/1968 | Weggeland | 40/79 |
| 3,694,947 | 10/1972 | Mukai | 40/152 |
| 3,878,632 | 4/1975 | Berggren et al. | 40/152 |
| 4,057,920 | 11/1977 | Weggeland | 40/79 |
| 4,062,140 | 12/1977 | Meyer et al. | 40/152 |
| 4,173,838 | 11/1979 | Antos | 40/366 |
| 4,238,899 | 12/1980 | Ackeret | 40/513 |
| 4,241,528 | 12/1980 | Ackeret | 40/513 |
| 4,241,529 | 12/1980 | Baur | 40/513 |
| 4,242,817 | 1/1981 | Ballard | 40/10 D |
| 4,242,820 | 1/1981 | Ackeret | 40/513 |
| 4,245,417 | 1/1981 | Ackeret | 40/513 |
| 4,259,802 | 4/1981 | Ackeret | 40/513 |
| 4,413,435 | 11/1983 | Baur | 40/155 |
| 4,450,955 | 5/1984 | Featherstonn | 150/147 |
| 4,458,434 | 7/1984 | Ackeret | 40/513 |

FOREIGN PATENT DOCUMENTS

| | | | |
|---|---|---|---|
| 1772198 | 1/1971 | Fed. Rep. of Germany . | |
| 2212135 | 11/1972 | Fed. Rep. of Germany . | |
| 2457759 | 6/1974 | Fed. Rep. of Germany | 40/156 |
| 2742345 | 3/1979 | Fed. Rep. of Germany . | |
| 2950915 | 12/1979 | Fed. Rep. of Germany | 40/154 |
| 1281459 | 12/1961 | France . | |
| 490390 | 2/1954 | Italy | 40/122 |
| 1059689 | 2/1967 | United Kingdom | 40/10 D |

*Primary Examiner*—Gene Mancene
*Assistant Examiner*—Wenceslao J. Contreras
*Attorney, Agent, or Firm*—Jeffrey H. Ingerman

[57] ABSTRACT

A holder for a stack of a variable number of pictures is disclosed. The holder includes a clamping device whereby a stack of pictures in the holder is held against a window. Pictures can be added or removed at an open end of the window frame or through the back of the frame. Alignment devices are provided, preferably on at least two sides of the frame, to align the uppermost picture in the stack with the window.

13 Claims, 7 Drawing Sheets

Fig. 12
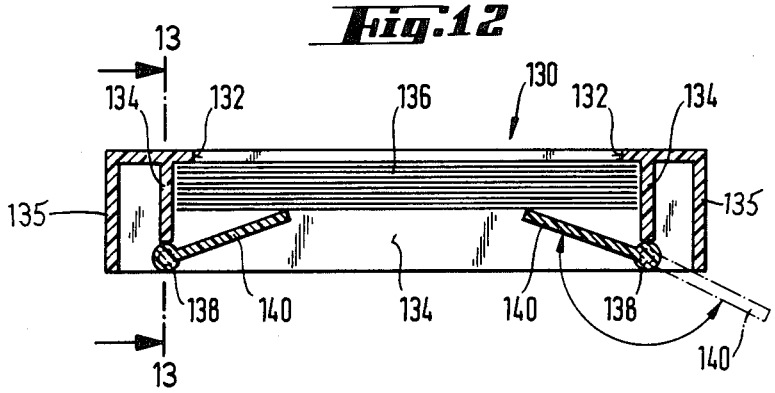
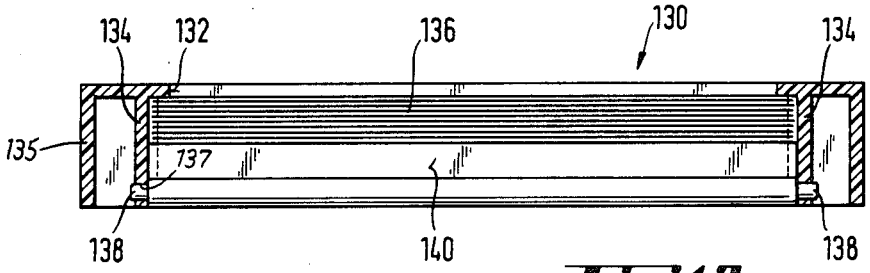
Fig. 13
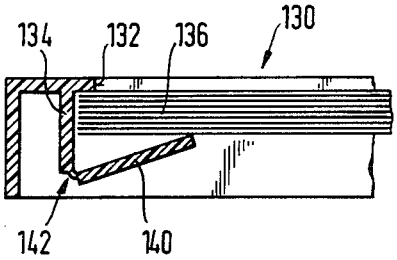
Fig. 14

HOLDER FOR A STACK OF PICTURES

CROSS-REFERENCE TO RELATED APPLICATION

This application is a division of copending U.S. patent application Ser. No. 537,521, filed Sept. 30, 1983 now abandoned.

BACKGROUND OF THE INVENTION

The invention relates to holders for stacks of pictures, and relates more particularly to holders capable of holding stacks of different thicknesses, such as stacks comprising different numbers of pictures. A holder of this general type is described in my U.S. Pat. No. 4,242,820, issued Jan. 6, 1981.

Known picture holders typically enclose a stack of pictures completely. Therefore, in order to add or remove pictures from the stack, the holder must be opened. The bias system for engaging the stack of pictures in the holder is disabled when the holder is opened. Such known picture holders are relatively complex.

It is an object of the present invention to provide a picture holder having a simple bias system, capable of being manufactured with minimum expense.

It is a further object of the invention to provide a picture holder having means for positioning pictures in a window display.

SUMMARY OF THE INVENTION

The picture holder of the invention comprises a window for displaying the uppermost picture of a stack of pictures, a clamping device for holding pictures in the holder and against the window, and alignment means for positioning the stack relative to the display window.

BRIEF DESCRIPTION OF THE FIGURES

FIG. 12 is an end view of a fifth preferred embodiment.

FIG. 13 is a sectional view of the fifth embodiment, taken from line 13—13 of FIG. 12.

FIG. 14 is an end view of a sixth preferred embodiment.

FIG. 24 is taken from line 24—24 of FIG. 23.

DETAILED DESCRIPTION OF THE PREFERRED EMBODIMENTS

Figure 1:
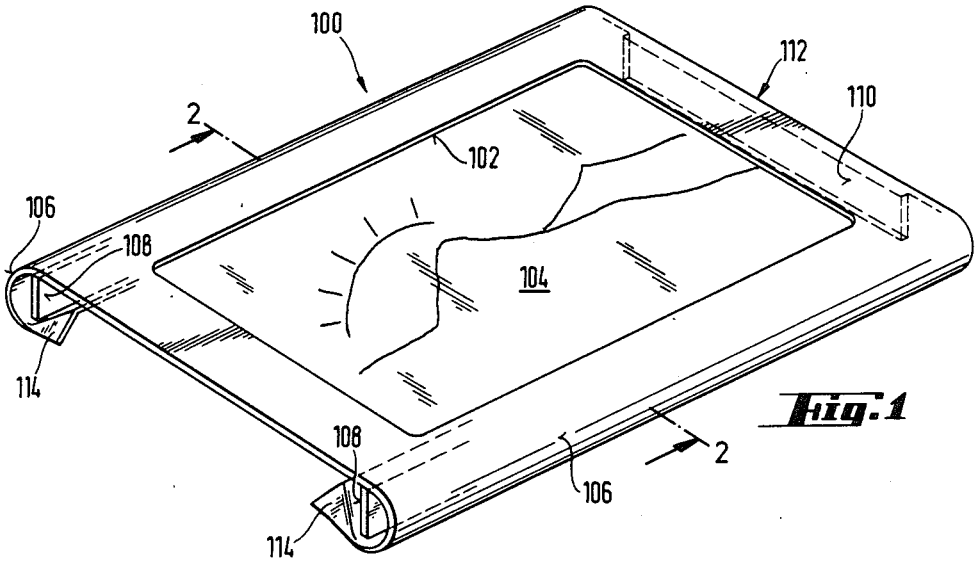
FIG. 1 is an isometric view of a first preferred embodiment.

FIG. 1 shows a frame 100 having a window cut-out section 102 that surrounds and defines a window. The uppermost picture 104 of a stack of pictures is shown displayed in the window 102. Edge parts 106 are provided at the longitudinal sides of the frame 100 and serve as clamping means, as described below. Edge parts 106 extend behind the window (i.e., below the window in FIGS. 1 and 2) and bend toward the underside of window 102, and are adapted to resiliently open to receive the stack of pictures and urge the stack behind the window against the frame portion 100. If a pane is inserted into the window cut-out section 102, the pictures are urged flat against the pane. The stack is aligned along the longitudinal sides of the frame by longitudinal stop means or alignment means 108. Stop means 108 extend along the cavities formed by edge parts 106. Transverse abutment stop or alignment means 110 (FIG. 2) extends orthogonal to stop means 108 and downward (in FIG. 1) from transverse edge 112 of frame 100. The end of the frame opposite stop member 110 is open for removing or adding pictures. The insertion of a stack of pictures is facilitated by the fact that corners 114 of the edge parts 106 extend angularly away from the window cut-out section 102 to form a ramp along which the stack can be guided.

Figure 2:
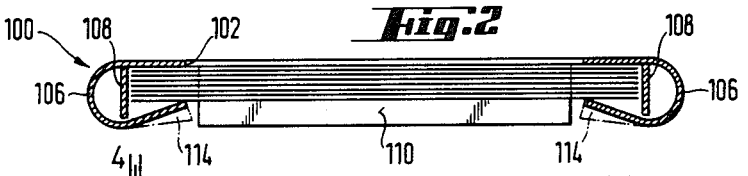
FIG. 2 is a sectional view taken from line 2—2 of FIG. 1.

The resilient deflection of edge parts 106 depends upon the thickness of the stack. A wide range of stack thicknesses can be accommodated if, for example, edge parts 106 made of elastic steel are mounted to a plastic frame 100 as shown in FIG. 2. The stop means 108 and 110 are integral with the plastic frame. Even if transverse abutment stop 110 is integral with the frame 100, deflection of edge parts 106 is not prevented because stop 110 is separated at both of its ends from edge parts 106 (FIG. 2).

Figure 3:
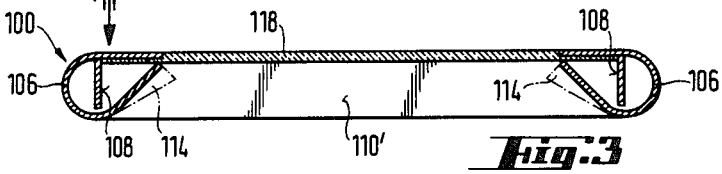
FIG. 3 is a view analogous to the view shown in FIG. 2, but shows a second preferred embodiment.
Figure 4:
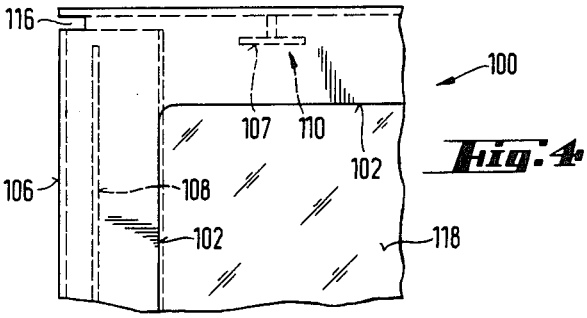
FIG. 4 is a partial top view of the second embodiment, taken from arrow 4 of FIG. 3.

A second alternative embodiment wherein the transverse abutment stop 110' extends over the entire length of transverse edge 112 of the frame 100 is illustrated in FIGS. 3 and 4. A separating slot 116 is provided to permit unrestricted resilient deflection of the edge parts 106. T-members 107, integrally formed with the transverse abutment stop 110 and extending inward, ensure that the stack of pictures is covered by the frame to the same extent on each side (it is desired that this coverage be as small as possible). Further, this alternative version is provided with a window pane 118 inserted in window cut-out section 102 of frame 100.

Figure 5:
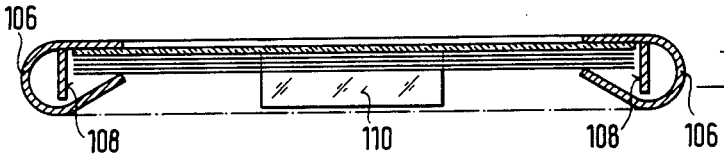
FIG. 5 is a sectional view taken from line 5—5 of FIG. 7, showing a third preferred embodiment wherein a transverse stop means is disposed in a separate holding member.
Figure 7:
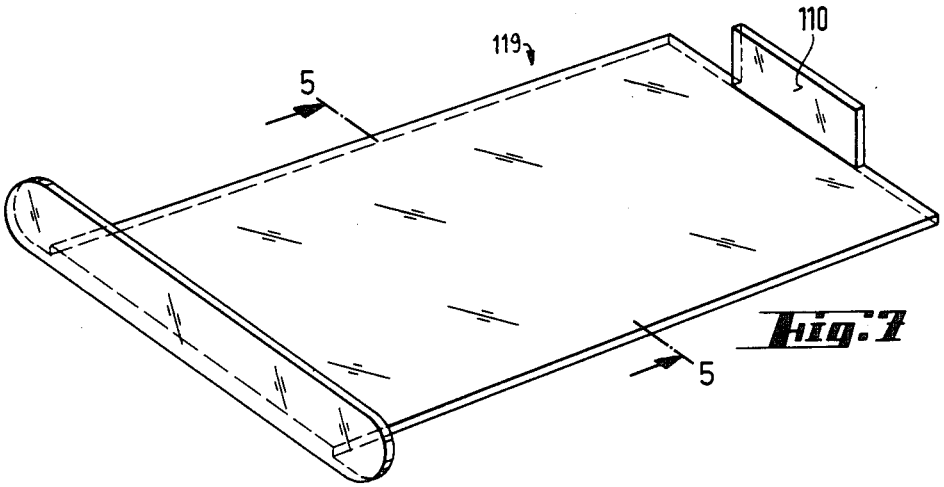
FIG. 7 is an isometric view of the holding member of the third embodiment.

FIGS. 5–8 show third and fourth alternative embodiments. In the embodiment of FIGS. 5 and 7, the stack of pictures is contained in a holding member 119 (illustrated in FIG. 7). Holding member 119 comprises stop members or alignment means 110 which extend transversely with respect to the resilient edge parts 106. The holding member 119, containing a stack of pictures between members 108, is pushed into frame 100 under edge parts 106 so that the latter press the stack against the holding member 119, as shown in FIG. 5.

Figure 6:
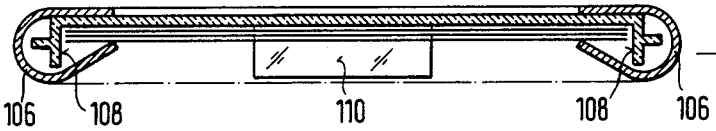
FIG. 6 is a sectional view taken from line 6—6 of FIG. 8 showing a fourth preferred embodiment wherein transverse and longitudinal stop means are disposed in a separate holding member.
Figure 8:
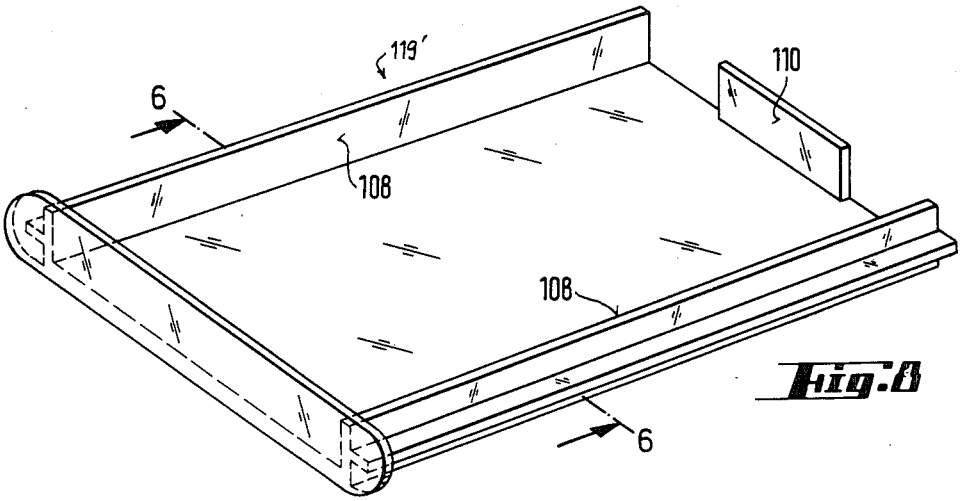
FIG. 8 is an isometric view of the holding member of the fourth embodiment.

In the embodiment of FIGS. 6 and 8, holding member 119' (FIG. 8) also has stop means or alignment means 108 which extend parallel to edge parts 106. Thus, holding member 119' provides alignment means on all sides of the stack. In both embodiments, holding members 119 and 119' serve as window panes and so are made of a transparent material, such as clear plastic.

Figure 10:
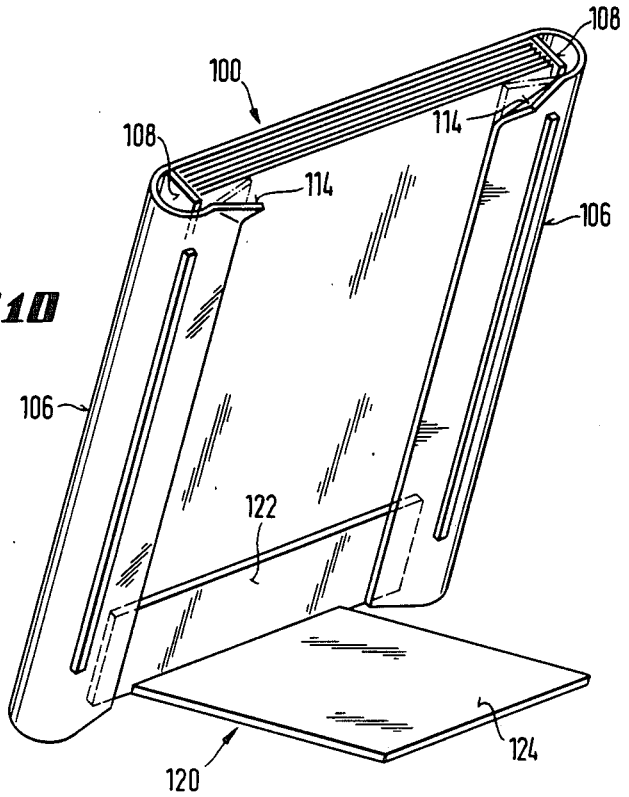
FIGS. 9–11 illustrate a simple additional member by means of which the holder can be transformed to a stand-up frame.
Figure 11:
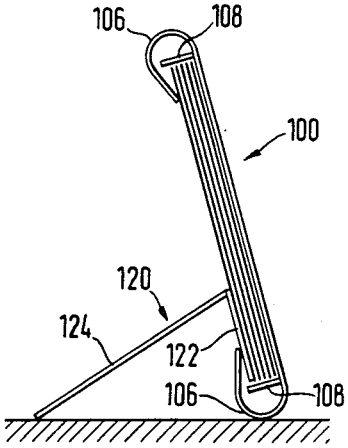
Figure 9:
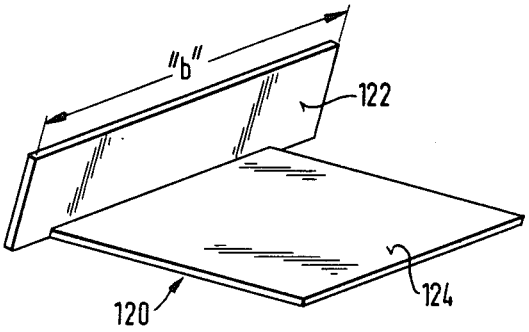
Figure 15:
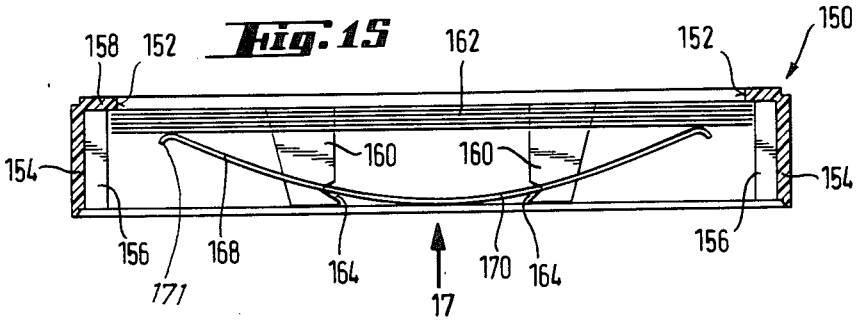
FIG. 15 shows a side view of a seventh preferred embodiment, having a spring arm biasing means.

FIG. 9 illustrates an injection molded part 120 comprising two plate-shaped sections 122 and 126. Plate-shaped section 122 has a width "b" equal to the width of the pictures to be held and is secured at one edge to the other plate-shaped section 124 at an angle. Section 122 can be inserted together with a stack of pictures into the holder as shown in FIG. 10, with section 122 lying between the stack and the resilient edge parts 106. The narrower plate-shaped section 124 serves as a foot to support the holder as an up-standing frame. FIG. 11 illustrates in side view how part 120 is inserted if the holder is to be used as a frame with transversely formed pictures, i.e., with section 122 between the stack and only one edge part 106.

In the fifth embodiment, shown in FIGS. 12 and 13, the clamping means do not engage the stack with elastic bias but hold the stack in place by means of friction. The holder in the fifth embodiment comprises a double wall structure frame 130 having four inner walls 134 and four outer walls 135, and having a window opening 132, with or without a pane. The inner walls 134 of the double wall structure 130 form aligning stop means or alignment means to adjoin a picture stack 136 with respect to the window opening 132. Two opposing inner walls 134 (of the four inner walls) further have pivot openings 137 which each receive a respective pin 138. Each pin 138 is integrally formed with a respective vane or clamping means 140. The width of the vanes is dimensioned such that two edges of each vane 140 frictionally engage the two remaining inner walls 134 of the double wall structure 130 (i.e., those inner walls 134 to which the vanes 140 are not hinged). Because of this frictional engagement, vanes 140 will remain in a position into which they have been brought manually; if moved as far as possible against the stack 136, therefore, the vanes 140 urge the stack 136 flat against the back of window opening 132.

As is illustrated in FIG. 14, a pin pivot is not required. For example, if a suitable plastic material such as polypropylene is used, a pivot 142 can be formed integrally with respect to the frame and the vanes.

Figure 16:
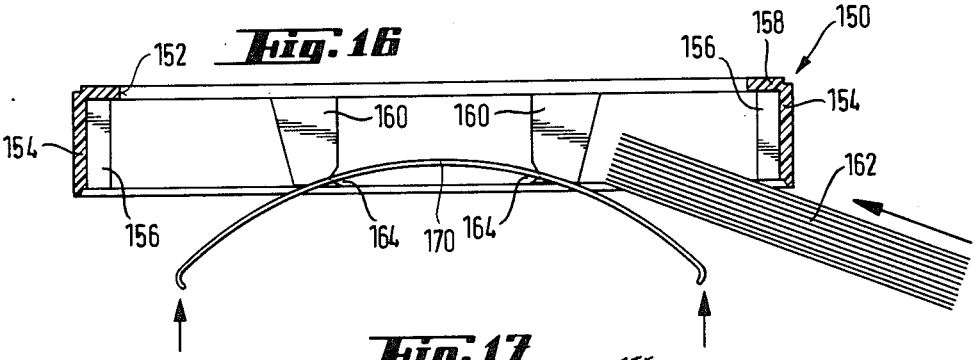
FIG. 16 shows the seventh embodiment in its stack exchange position.
Figure 17:
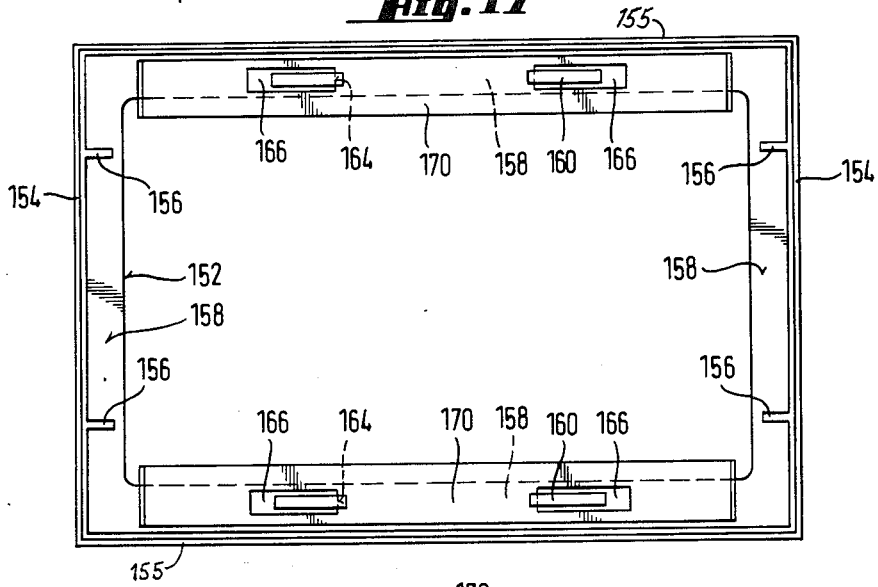
FIG. 17 is a bottom view taken from arrow 17 of FIG. 15 of the seventh embodiment.
Figure 18:
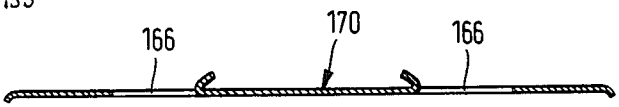
FIG. 18 is a side view of one of the spring arms in its unstressed position in the seventh embodiment.

FIGS. 15–18 illustrate a seventh embodiment. The holder comprises a frame 150 having a window opening 152 and aligning stop means or alignment means 156 at and integral with the shorter or transverse side walls 154 of the frame (see FIG. 17). Window opening 152 can be provided with a transparent plastic pane. Also integrally formed with the frame 150 are posts 160 which extend back from a front plate 158 and parallel to longitudinal or longer side walls 155. Posts 160 serve as stop means for supporting a stack of pictures 162 at the longer edges of the pictures. Posts 160 have incisions 164 into which a biasing means, such as leaf springs or spring arms 168, are mounted. Each spring arm 168 has a pair of holes 166. The distance between holes 166 on each spring arm 168 exceeds the distance between the incisions 164 on posts 160 into which the spring arm 168 is mounted. Each spring arm, thus, can assume two positions. In the first position (FIG. 15), the free ends 171 of the spring arms 168 bias the stack 162 to the window 152. If pressure is exerted on central spring bow 170 of spring arms 168 between posts 160, the spring arm 168 will snap into the second position, shown in FIG. 16. This spring movement is the so-called "frog-spring effect" or "snap-spring effect". A stack can be removed or inserted when the spring arms 168 are in the second position, as illustrated in FIG. 16. After insertion of a stack 162, a push on the spring ends 171 in the direction of the arrows shown in FIG. 16 will reestablish the first position shown in FIG. 15.

Figure 19:
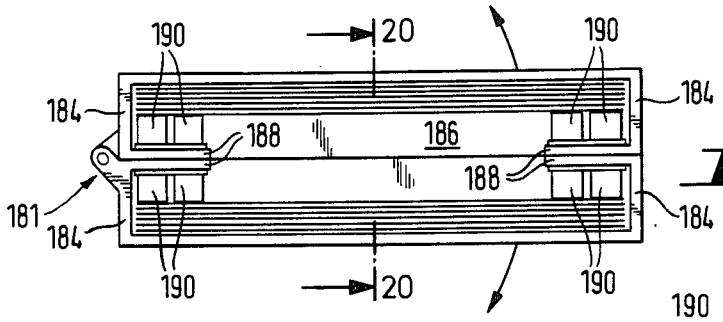
FIG. 19 is a top plan view of an eighth preferred embodiment.
Figure 20:
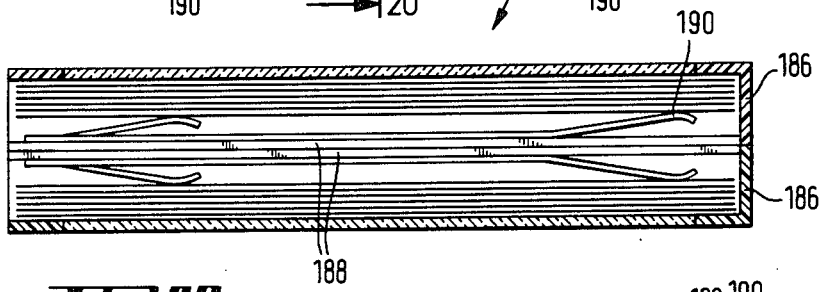
FIG. 20 is a sectional view of the eighth embodiment, taken along line 20—20 of FIG. 19.
Figure 21:
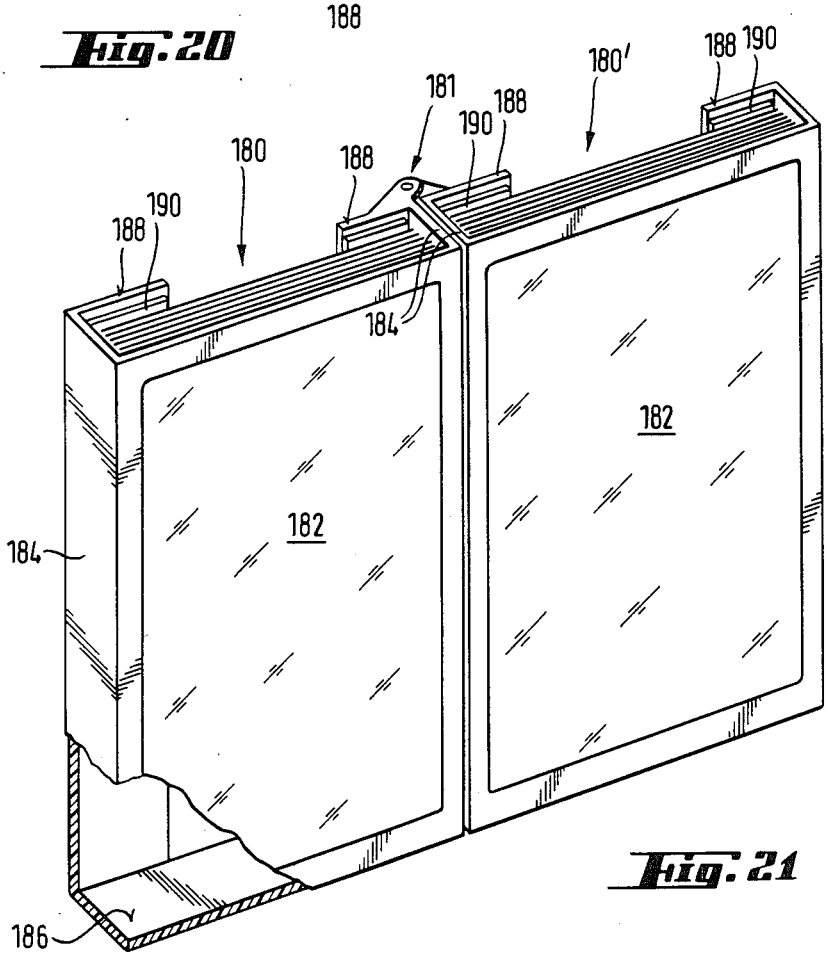
FIG. 21 is a perspective view of the eighth embodiment.

FIGS. 19–21 illustrate an eighth embodiment, in which two holders 180 and 180' are connected by means of a pivot 181. The holders may be disposed such that the two windows 182 are either juxtaposed (FIG. 21) or back-to-back (FIGS. 19 and 20). The holders 180 and 180' each comprise side walls 184 perpendicular to the window, bottom wall 186 perpendicular to and connecting side walls 184, and support rails 188 extending toward each other from the side walls 184. A biasing means, such as leaf springs 190, is received in the spaces defined by rails 188 and the front of each holder for urging an inserted stack of pictures toward windows 182, as shown in FIG. 20. The stack can be exchanged via the open top of the holder.

Figure 22:
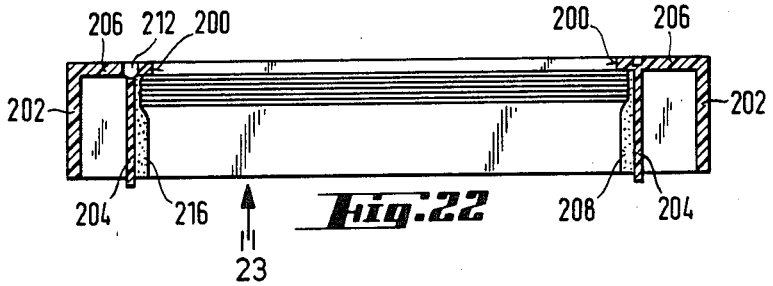
FIG. 22 is an end view of a ninth preferred embodiment.
Figure 23:
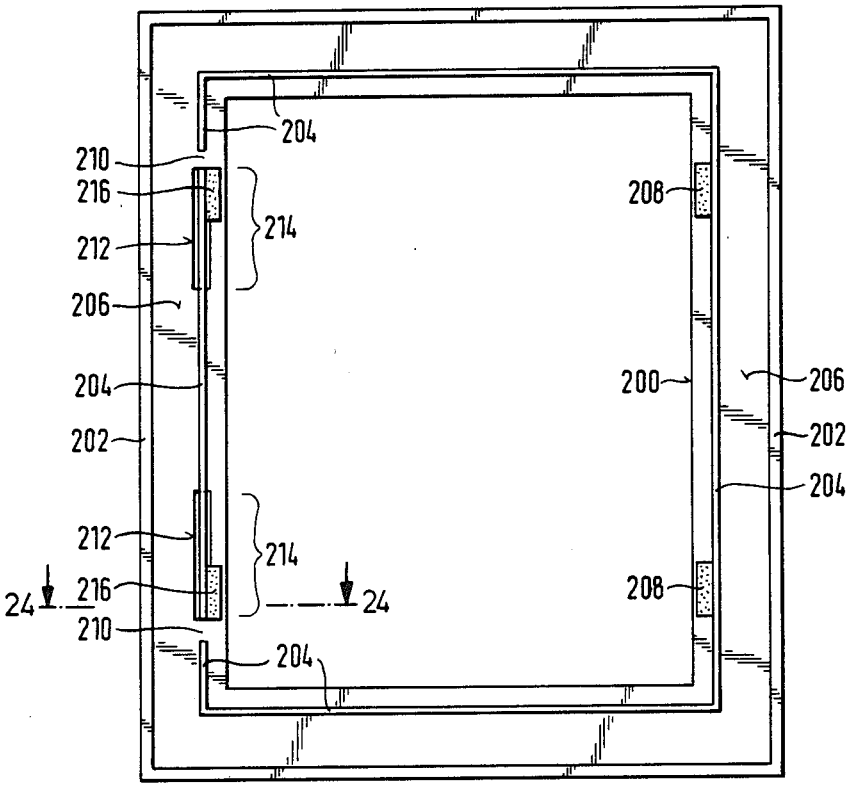
FIG. 23 is a bottom view taken from arrow 23 of FIG. 22 of the ninth embodiment.
Figure 24:
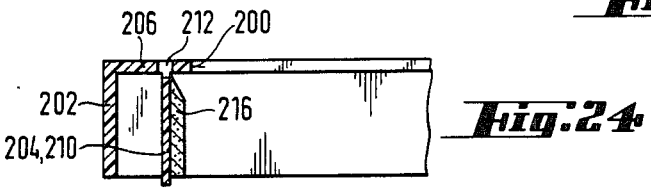
FIGS. 24 and 25 illustrate an inner deflectable wall of the ninth embodiment with the holder empty and during insertion of a stack of pictures, respectively.
Figure 25:
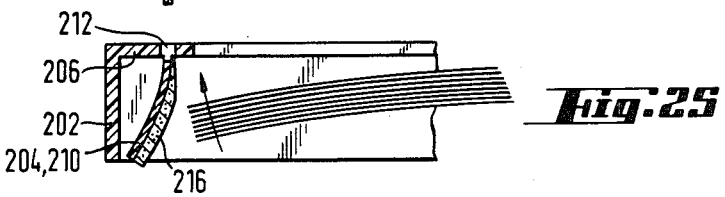

FIGS. 22–25 illustrate a ninth embodiment. The holder, like the fifth and sixth embodiments shown in FIGS. 12–14, has a double wall structure comprising outer walls 202, inner walls 204, and frame member 206 surrounding and defining a window 200. Two strips 208 of volume compressible material, such as foamed plastic, are mounted, such as by gluing, on one of the longer or longitudinal inner walls 204 (on the right-hand side of FIG. 23). The opposite (left-hand) inner wall 204 is provided with incisions 210 respectively opposite strips 208, to form a deflectable member 214. Indentations 212 formed in the frame member 206 to which member 214 is attached permit member 214 to be elastically deflected toward the adjacent, parallel outer wall 202, as shown in FIG. 25. On the deflectable member 214, at places opposite to strips 208, strips 216 similar to strips 208 are secured. The distance between the two opposite inner walls 204 is selected in accordance with the respective dimension of the stack to be held by the holder. To permit the insertion of the stack (FIG. 25), the inner wall portion 214 is deflected. The stack compresses strips 208 and 216, as seen in FIG. 22. As can be seen in FIG. 24, however, strip 216 tapers in the direction of the window so that the uppermost picture can flatly engage in the window without having to press against a thickness of compressible material.

I claim:

1. A holder for a stack of pictures, said holder comprising a frame having a window cut-out section spaced inwards from an outer contour of said frame, said window cut-out section defining a plane for display of one picture of a picture stack, said frame having an opening for insertion and removal of a picture stack in a direction substantially parallel to said plane, a first alignment means for engaging a first picture edge opposite said opening and disposed between said outer frame contour and said window cut-out section, at least one second alignment means for engaging a second picture edge orthogonal to said first edge and disposed between said outer frame contour and said window cut-out section, spring-biased clamping means supported by said frame for embracing an inserted picture stack adjacent its edges and for holding it against said window cut-out section irrespective of the number of pictures forming said stack, and means for deflecting said clamping means upon insertion of a stack between said window cut-out section and said clamping means.

2. A holder as set forth in claim 1, said holder comprising two of said second alignment means for supporting second and third edges of a stack in said holder, the stack being removable in the direction of its non-supported edge.

3. A holder as set forth in claim 1, further comprising a transparent pane covering said window.

4. A holder as set forth in claim 3, wherein said alignment means for presenting at least an uppermost picture in a stack of pictures substantially behind said pane, said pane being surrounded by said frame.

5. A holder as set forth in claim 1, wherein said first and second alignment means are integrally formed with said frame.

6. A holder as set forth in claim 1, wherein said frame comprises a first member containing said window cut-out section, said clamping means being integrally formed with said first member, and a second member insertable into said first member, said second member comprising a window pane and having said alignment means integrally formed therewith.

7. A holder as set forth in claim 1, wherein said clamping means remains engaged while a stack of pictures is being removed.

8. A holder as set forth in claim 1, wherein said window cut-out section is made from a different material than said clamping means.

9. A holder as set forth in claim 1, further comprising a stack carrier which may be inserted and removed, together with a stack, via said opening.

10. A holder as set forth in claim 9, wherein at least one of said alignment means is mounted on said carrier.

11. A holder as set forth in claim 10, wherein said carrier includes a plurality of alignment means.

12. A holder as set forth in claim 9, wherein said carrier includes a transparent pane adapted to be aligned with said window cut-out section.

13. A holder as set forth in claim 9, wherein said carrier includes a cover member adapted to close said opening said carrier is inserted in said frame.

* * * * *